United States Patent [19]

Echterling

[11] 4,271,627

[45] Jun. 9, 1981

[54] DOLL HIGH CHAIR AND SWING

[75] Inventor: Eugene Echterling, Brentwood, Tenn.

[73] Assignee: Louis Marx & Co., Inc., Stamford, Conn.

[21] Appl. No.: 10,861

[22] Filed: Feb. 9, 1979

[51] Int. Cl.[3] ..... A63H 3/52

[52] U.S. Cl. ..... 46/15; 272/85; 297/130

[58] Field of Search ..... 46/1 R, 14, 15, 17; 272/85; D6/8; 297/130, 273, 274

[56] References Cited

U.S. PATENT DOCUMENTS

| | | | |
|---|---|---|---|
| 1,377,422 | 5/1921 | Loffi | 297/130 |
| 2,533,019 | 12/1950 | Ketcham | 297/130 |
| 3,731,420 | 5/1973 | Crosman | 46/1 R |

FOREIGN PATENT DOCUMENTS

| | | | |
|---|---|---|---|
| 133743 | 12/1901 | Fed. Rep. of Germany | 297/130 |

*Primary Examiner*—William A. Cuchlinski, Jr.
*Attorney, Agent, or Firm*—Blum, Kaplan, Friedman, Silberman & Beran

[57] ABSTRACT

A doll high chair and swing construction is provided, having a frame formed with an upper support having at least one support location on an upper region thereof. A seat member is formed with at least one supportable region adapted for cooperation with the support location to support the chair on the frame. Also provided is a swing member formed on one side with a supportable region adapted for cooperation with the support location to define a pivotal support for the swing member, the swing member being formed with a support location at a side thereof spaced from the supportable region thereof for cooperation with the seat member to support the seat member for swinging displacement within the frame below the frame support location.

8 Claims, 14 Drawing Figures

FIG. 1
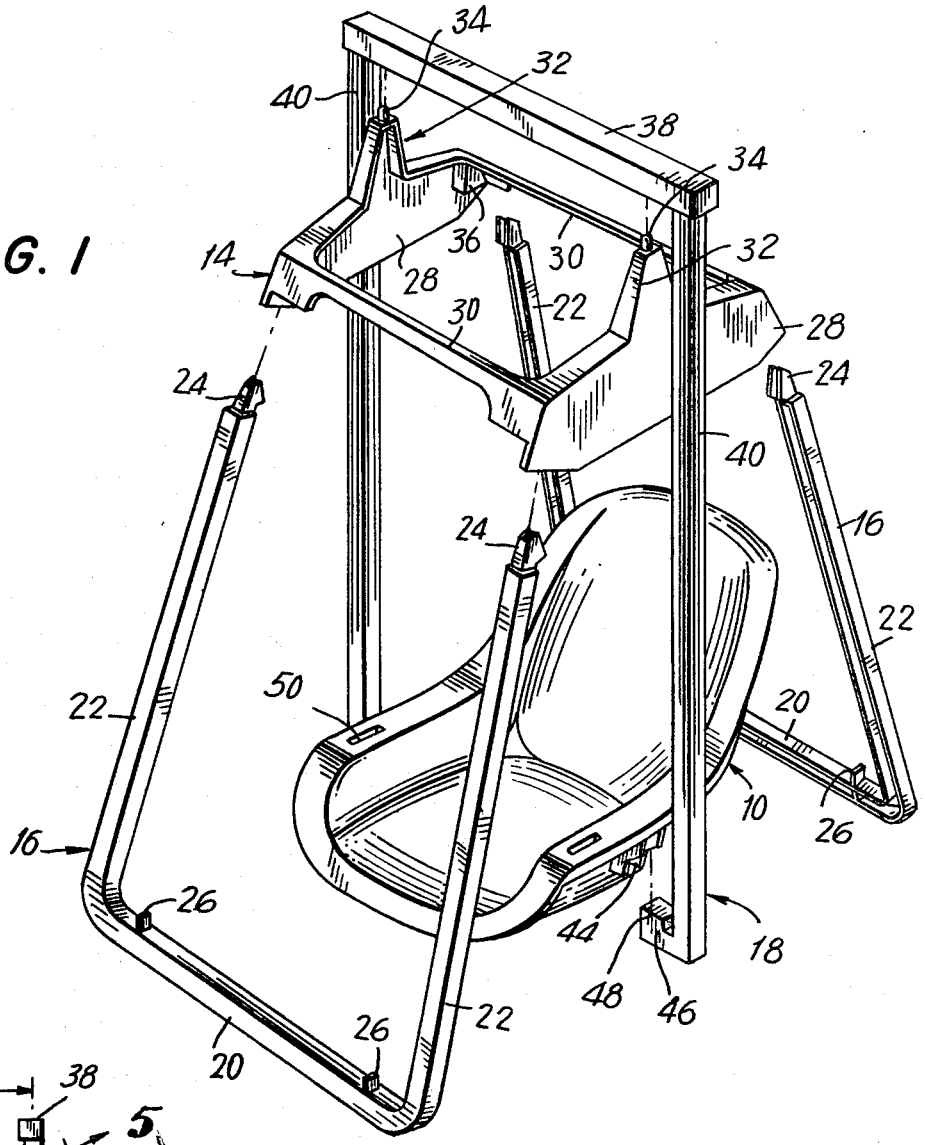
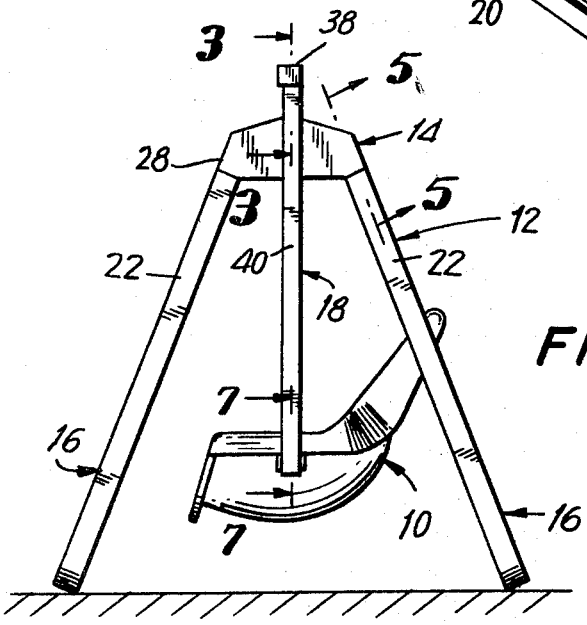
FIG. 2

FIG. 3
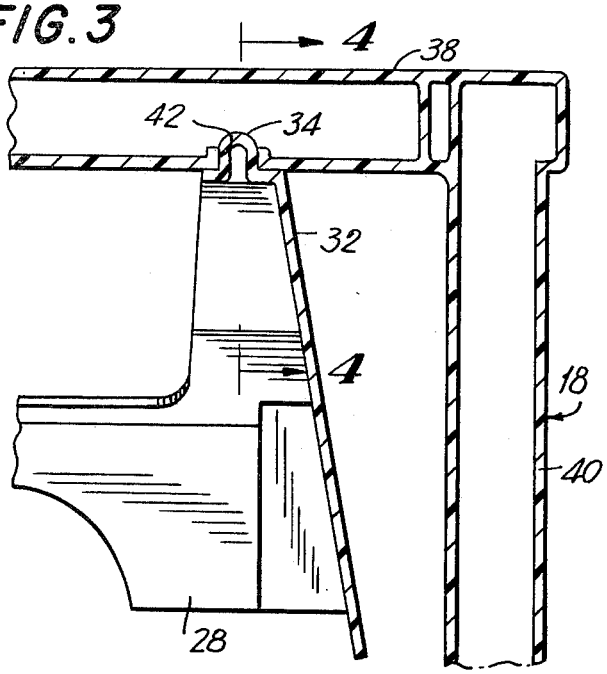
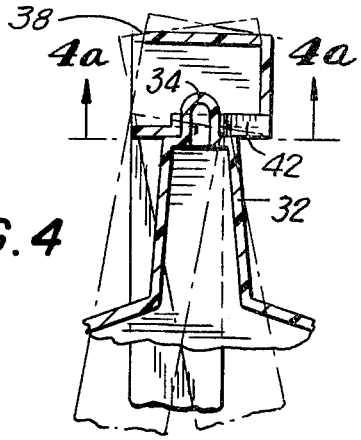
FIG. 4
FIG. 4a
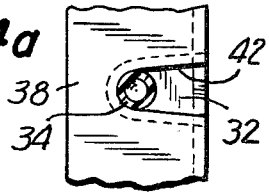
FIG. 5
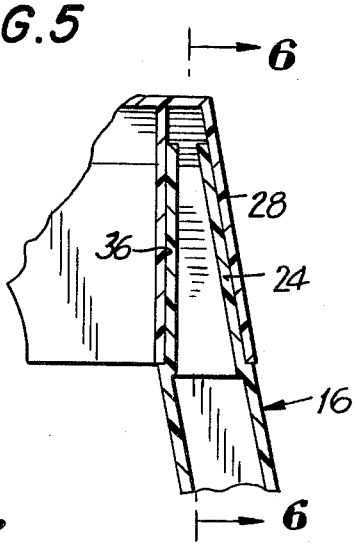
FIG. 6
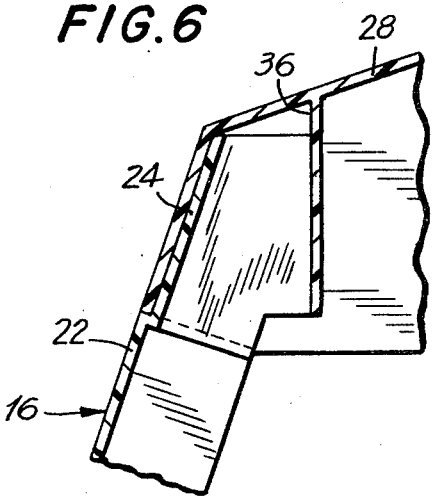
FIG. 7
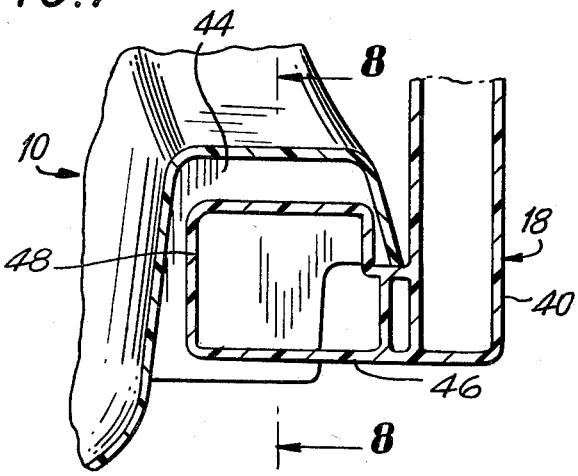
FIG. 8
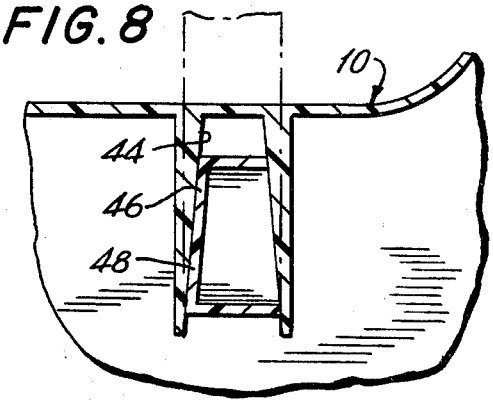

54
52
10
14
12
16
18
50
11
44
34
32
36
22
24
20
26
42
46
48
40

DOLL HIGH CHAIR AND SWING

BACKGROUND OF THE INVENTION

This invention relates generally to the field of doll furniture wherein it is desirable to provide furniture and implements for use by dolls to enhance the play value of such dolls. Among the types of devices and furniture frequently provided for dolls are high chairs and swings. When sold separately, such items can prove expensive and difficult to store, thereby discouraging the purchase of both items, thereby lessening the play value of the doll.

By providing a combined high chair and swing utilizing a minimum number of parts, the play value of the doll is greatly enhanced while the cost to the user are greatly reduced.

SUMMARY OF THE INVENTION

Generally speaking, in accordance with the invention, a combined doll high chair and swing arrangement is provided, including frame means formed in an upper region thereof with at least one upwardly facing support location; a seat member formed with a supportable region, said seat member supportable region and upper support location being adapted to releasably support said seat member on said upper region of said frame means; a swing means having first and second opposed ends, said swing means first end being formed with a supportable region adapted for cooperation with said frame means support location to provide pivotable support for said swing means with the second end thereof below the first end and said frame means support location, and said swing means second end being formed with at least one support location adapted for cooperation with said seat member to support said seat member for swinging displacement below said frame means support location.

Both the frame means and the swing member may each be formed with a pair of support locations, the seat member being formed with a pair of supportable regions defining sockets for receipt of projections defining each of said pairs of support locations. The frame means may be formed from an essentially inverted V-shape. The base of said frame means may be adapted to support said swing member for storage.

Accordingly, it is an object of this invention to provide a combination doll high chair and swing utilizing a common seat and minimum frame.

A further object of the invention is to provide a combined doll high chair and swing which is readily collapsible and is inexpensive to manufacture.

Still other objects and advantages of the invention will in part be obvious and will in part be apparent from the specification.

The invention accordingly comprises the features of construction, combinations of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 1 is an exploded perspective view of the doll high chair and swing in accordance with the invention showing assembly as a swing;

FIG. 2 is a side elevational view of an assembled doll high chair and swing oriented as a swing;

FIGS. 3, 5 and 7 are sectional views taken along lines 3—3, 5—5 and 7—7 respectively of FIG. 2;

FIG. 4 is a sectional view taken along lines 4—4 of FIG. 3;

FIG. 4*a* is a sectional view taken along lines 4*a*—4*a* of FIG. 4;

FIG. 6 is a sectional view taken along lines 6—6 of FIG. 5;

FIG. 8 is a sectional view taken along lines 8—8 of FIG. 7;

DESCRIPTION OF THE PREFERRED EMBODIMENTS

Figures 9, 10, 11, 12, 13:
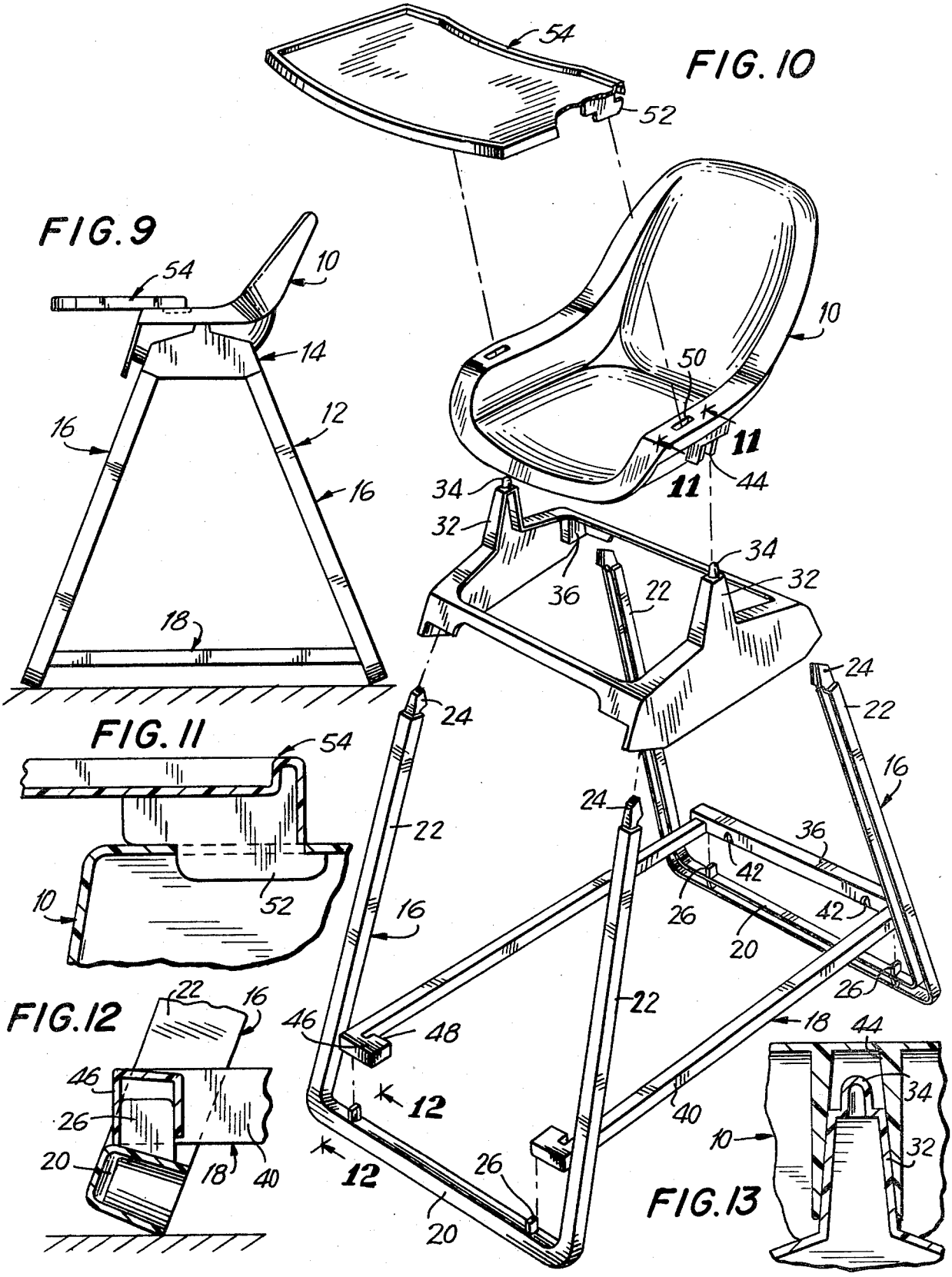
FIG. 9 is a side elevational view of the doll high chair and swing in accordance with the invention assembled as a high chair.
FIG. 10 is an exploded perspective view of the arrangement of FIG. 9.
FIGS. 11 and 12 are sectional views taken along lines 11—11 and 12—12 perspectively of FIG. 10.
FIG. 13 is a sectional view taken through the support location of the frame means showing the support for the seat member as assembled in FIG. 9.

Referring now to FIGS. 1–8, the combined doll high chair and swing arrangement includes a seat member 10 a frame 12 formed from an upper support 14 and a pair of U-shaped legs 16, and a swing member 18. Each of the components are preferably formed from molded plastic.

Referring first to U-shaped legs 16, each said leg consists of an essentially horizontally extending base 20 and a pair of arms 22 projecting from each side of base 20, the respective arms 22 being inclined at an angle towards each other so that the end fitting 24 formed on the end of each of arms 22 are more closely spaced than the ends of base 20. Legs 16 have a U-shaped cross section for ease of molding. The upper surface of base 20 is formed with a pair of spaced upwardly extending projections 26, the purpose of which will be described in connection with the swing embodiment.

Support 14 is formed from a pair of side portions 28 spaced from each other and supported by integrally formed beam portions 30. Each side portion is formed with an upwardly extending tapered frame support location 32 which is in turn formed at the end thereof with a rounded short pivot projection 34. As more particularly shown in FIG. 6, each end fitting 24 is shaped and dimensioned for receipt in a socket 36 formed in the inner corner of each side portion 28, an arrangement which permits the assembly of the components defining frame 12 and the ready disassembly thereof for storage. The resulting assembled essentially inverted V-shaped frame 12 is free-standing on bases 20 of legs 16. Swing member 18 consists of an essentially U-shaped molded member having a base portion 38 and a pair of arm portions 40. Swing member 18 is molded as a unit, the cross section of the respective portions thereof being essentially U-shaped. As more particularly seen in FIGS. 3, 4 and 4*a*, the bottom wall of base portion 38 thereof is formed with a pair of spaced tapered slots 42 which terminate midway in the width of said bottom wall of base portion 38, said terminal end of slot 42 being shaped and dimensioned to receive a pivot projection 34 as illustrated in FIGS. 3, 4 and 4*a*. This mounting arrangement permits the pivoting of the swing member 18 about the axis defined by the pivot projections 34 as illustrated in chain lines in FIG. 4.

Seat member 10 is formed with a seat of conventional shape, also from a single molded part. The arm rest regions of the seat member 10 project laterally on each side thereof and immediately below each such arm-rest portion are a pair of downwardly projecting walls which define a socket or supportable region 44. The end of each arm portion 40 of swing member 18 is formed with an inwardly projecting portion 46 which is in turn formed with an upwardly projecting portion 48 at the end thereof defining a support location. As best seen in FIGS. 7 and 8, each socket 44 of seat member 10 and portions 46 and 48 of frame 18 are dimensioned for mating interengagement whereby the seat member 10 is supported within the spaced defined by frame 12 for swinging displacement therein.

Referring to FIGS. 9–13, the high chair orientation of the arrangement in accordance with the invention is depicted. Frame 12 is assembled as described above. Swing member 18 may be stored on the bases 20 of legs 16 and retained in position by the projections 26 being received in the channel defined by the U-shaped cross section of frame member 18 (FIG. 12). Socket 44 and support location 32 are likewise correspondingly shaped so that seat member 10 may be positioned and supported by support member 14 of frame 12 as illustrated in FIGS. 9 and 13. Seat member 12 is also formed with a pair of through-slots 50 in the arm-rest portions thereof for receipt of tabs 52 of a tray member 54 as illustrated in FIGS. 9, 10 and 11.

By the foregoing arrangement, the same components that formed the swing now define a doll high chair, with swing member 18 providing additional support for the frame 12.

It will thus been seen that the objects set forth above, and those made apparent from the preceding description, are efficiently obtained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A combined doll high chair and swing comprising means formed in an upper region thereof with a pair of spaced upwardly facing support locations; a seat member formed with a pair of spaced supportable regions, said seat member supportable regions and frame means support locations being adapted for cooperation to releasably support said seat member on said upper region of said frame means, and swing means having first and second portions joined with each other, said swing means first portion being formed with a pair of spaced supportable regions adapted for cooperation with said frame means support locations to provide releasable pivotable support for said swing means on said frame means with the second portion of said swing means positioned below said first portion thereof and below said frame means support locations, said swing means second portion being formed with a pair of spaced support locations adapted for cooperation with said seat member supportable regions to support said seat member for swinging displacement below said frame means support locations, each of said support locations comprising a projecting portion, said seat member supportable regions defining sockets for receipt of the corresponding projections.

2. A combined doll high chair and swing as claimed in claim 1, wherein said frame means support locations are each formed with a further pivot projection at the end of said firstmentioned projecting portion, said swing means supportable region including an opening for receipt of said further pivot projection and for permitting said swinging displacement.

3. A combined doll high chair and swing as claimed in claim 1, wherein said frame means substantially defines an inverted V defined by a pair of leg portions.

4. A combined doll high chair and swing as claimed in claim 3, wherein said leg portions and swing means are adapted so that said swing means may be received and retained by said leg portions when said combined doll high chair and swing is oriented as a high chair.

5. A combined doll high chair and swing as claimed in claim 4, wherein said leg portions of said frame means are essentially U-shaped with the arms of said U-shaped leg portions being inclined toward each other, each of said leg portions being formed with projections in the base thereof for receipt and retention of said frame means.

6. A combined doll high chair and swing as claimed in claim 5, wherein said frame means is essentially U-shaped, and having a base which extends over said frame means when pivotally mounted thereon and a pair of downwardly projecting arms which extend on opposed sides of said frame means for support of said seat member therebetween within said inverted V-shaped frame means.

7. A combined doll high chair and swing comprising means formed in an upper region thereof with at least one upwardly facing support location; a seat member formed with a supportable region, said seat member supportable region and frame means support location being adapted to releasably support said seat member on said upper region of said frame means; and swing means having first and second portions joined with each other, said swing means first portion being formed with a supportable region adapted for cooperation with said frame means support location to provide releasable pivotable support for said swing means on said frame means with the second portion of said swing means positioned below said first portion thereof and below said frame means support location, said swing means second portion being formed with at least one support location adapted for cooperation with said seat member to support said seat member for swinging displacement below said frame means support location, said frame means substantially defining an inverted V defined by a pair of leg portions, said leg portions and swing means being adapted so that said swing means may be received and retained by said leg portions when said combined doll high chair and swing is oriented as a high chair, said leg portions of said frame means being essentially U-shaped with the arms of said U-shaped leg portions being inclined toward each other, each of said leg portions being formed with prorejections in the base thereof for receipt and retention of said frame means.

8. A combined doll high chair and swing as claimed in claim 7, wherein said frame means is essentially U-shaped, and having a base which extends over said frame means when pivotally mounted thereon and a pair of downwardly projecting arms which extend on opposed sides of said frame means for support of said seat member therebetween within said inverted V-shaped frame means.

* * * * *